US008465224B2

(12) United States Patent
Price et al.

(10) Patent No.: US 8,465,224 B2
(45) Date of Patent: Jun. 18, 2013

(54) MULTI-APPLICATION APPARATUS, METHODS AND SURFACE MARKINGS

(75) Inventors: Mark A. Price, Lake Oswego, OR (US); Spencer L. Cantwell, Sisters, OR (US); Robert Busse, Aurora, OR (US)

(73) Assignee: Specialized Pavement Marking, Inc., Tualatin, OR (US)

( * ) Notice: Subject to any disclaimer, the term of this patent is extended or adjusted under 35 U.S.C. 154(b) by 0 days.

(21) Appl. No.: 13/544,574

(22) Filed: Jul. 9, 2012

(65) Prior Publication Data

US 2013/0011193 A1 Jan. 10, 2013

Related U.S. Application Data

(60) Provisional application No. 61/505,841, filed on Jul. 8, 2011.

(51) Int. Cl.
*E01C 19/18* (2006.01)

(52) U.S. Cl.
USPC ..... 404/94; 404/111; 239/172

(58) Field of Classification Search
USPC ..... 404/93, 94, 111, 108; 239/172, 398, 239/722
See application file for complete search history.

(56) References Cited

U.S. PATENT DOCUMENTS

| | | | | |
|---|---|---|---|---|
| 2,898,825 | A * | 8/1959 | Walker et al. | 404/12 |
| 3,519,169 | A * | 7/1970 | Holland | 222/626 |
| 3,902,666 | A * | 9/1975 | Ito et al. | 239/130 |
| 4,856,931 | A * | 8/1989 | Bollag | 404/75 |
| 5,294,798 | A * | 3/1994 | Hartman | 250/458.1 |
| 5,439,312 | A | 8/1995 | Marcato | |
| 5,511,896 | A | 4/1996 | Marcato | |
| 5,544,972 | A * | 8/1996 | Boldt | 404/75 |
| 5,642,962 | A | 7/1997 | Marcato | |
| 5,895,173 | A * | 4/1999 | O'Brien et al. | 404/108 |
| 5,897,914 | A * | 4/1999 | DePriest | 427/137 |
| 6,918,714 | B2 * | 7/2005 | Chambard | 404/82 |
| 2010/0196095 | A1 * | 8/2010 | Bjorklund | 404/16 |
| 2011/0195179 | A1 * | 8/2011 | Davies et al. | 427/137 |

OTHER PUBLICATIONS

Hofmann GMBH Marketing Brochure "Hofmann Road Marking Systems", Rellingen, Germany.

* cited by examiner

*Primary Examiner* — Gary Hartmann
(74) *Attorney, Agent, or Firm* — Schwabe, Williamson & Wyatt

(57) ABSTRACT

In various embodiments, a multi-application apparatus may be configured to be mounted on a vehicle. The multi-application apparatus may include a sprayer configured to apply a profileable material to an area of a driving surface during a pass of the vehicle by the area to create a first marking. The multi-application apparatus may also include an applicator configured to apply the profileable material to at least a portion of the area of the driving surface during the same pass of the vehicle by the area to create a second marking. The second marking may have a more varied profile than the first marking. In various embodiments, the multi-application apparatus may include controls that enable independent control of various parameters during operation. In various embodiments, profileable material forming the second marking is at least partially fused with the profileable material forming the first marking.

11 Claims, 3 Drawing Sheets

MULTI-APPLICATION APPARATUS, METHODS AND SURFACE MARKINGS

CROSS REFERENCE TO RELATED APPLICATIONS

The present application claims priority to U.S. Provisional Patent Application No. 61/505,841, filed Jul. 8, 2011, entitled "Dual Application of Surface Markings," the entire disclosure of which is hereby incorporated by reference in its entirety.

TECHNICAL FIELD

Embodiments of the present invention relate to application of materials such as profileable material to driving surfaces.

BACKGROUND

Lines and other markings (hereafter "markings") may be applied to surfaces such as driving surfaces for a variety of reasons. For example, solid and/or dashed lines may be drawn along the middle of a roadway to delineate one lane from another. Such lines may indicate various rules of the road, such as when it is permissible to pass other vehicles. Lines may also be drawn in parking lots to demonstrate to visitors where vehicles should be parked.

Markings may be applied to a driving surface using a variety of materials or "binders," including but not limited to epoxy, thermoplastics, Methyl Methacrylate ("MMA"), and so forth. Some binders may be more viscous than others. For example, some forms of MMA and/or thermoplastic may be viscous enough to be considered "profileable." A material may be profileable when it is possible to apply the material to a driving surface so that the material retains a profile relative to the surface (e.g., when viewed from the side), rather than spreading across the surface as a less viscous liquid might. Some profileable materials may include sand and/or glass beads to increase profileability/viscosity.

Markings may be applied to a driving surface using a variety of techniques. For example, materials may be sprayed onto a surface using a sprayer. The resulting baseline markings may be fairly uniform; they may not include many "blank" portions or "gaps" through which the underlying surface is visible. Baseline markings also may have a fairly flat profile relative to the surface to which they are being applied. Baselines may typically be applied using materials of relatively low viscosity. Pumping more viscous materials such as profileable material through a sprayer may cause the sprayer head to be damaged quickly and frequently, in turn causing the applied baseline markings to have rough edges. This may be especially true where the profileable binder includes sand or other solid materials. Thus, where clean baseline markings are desired and profileable material is used, it may be necessary to frequently replace damaged sprayer heads.

Markings may be applied to a driving surface in a less uniform matter, such as in a controlled splatter or agglomeration. Unlike baseline markings, a splattered (also referred to as "agglomerated") marking may not be as uniform when viewed from above, and may include a number of gaps or holes through which the underlying surface is visible. A splattered marking may be applied using profileable binder, resulting in a non-flat or rough profile relative to the surface upon which it is applied. An agglomerated marking may also have less uniform or more rough edges than a baseline.

When using profileable material, in many cases driving surface markings are applied to a surface using a buggy.

Buggies typically are not usually much larger than a medium-sized car and typically store profileable material in pressure tanks Pressure tanks may be limited in size by various regulations and practical limitations (e.g., the small size of the buggy). Due to their relatively small size, it may be necessary to stop work and refill pressure tanks frequently. Additionally, static pressurized delivery systems associated with buggies may be dictated by ground speed.

Reflective elements such as glass beads or reflective ceramic elements may be embedded into a marking on a driving surface. The reflective elements may make markings easier to see in the dark because light from horizontally-aligned headlights may be more likely to be reflected from a reflective component embedded in binder. However, embedding relatively large/heavy reflective elements into binder may be challenging. If too much pressure is used to embed the elements into the binder, the binder may be flattened by the impact of the reflective elements or by excess air pressure. If too little pressure is used, on the other hand, the elements may not embed deep enough and may not be retained in the material.

BRIEF DESCRIPTION OF THE DRAWINGS

Embodiments of the present disclosure will be readily understood by the following detailed description in conjunction with the accompanying drawings. To facilitate this description, like reference numerals designate like structural elements. Embodiments of the disclosure are illustrated by way of example and not by way of limitation in the figures of the accompanying drawings.

DETAILED DESCRIPTION OF VARIOUS EMBODIMENTS

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present disclosure. Therefore, the following detailed description is not to be taken in a limiting sense.

Figure 1:
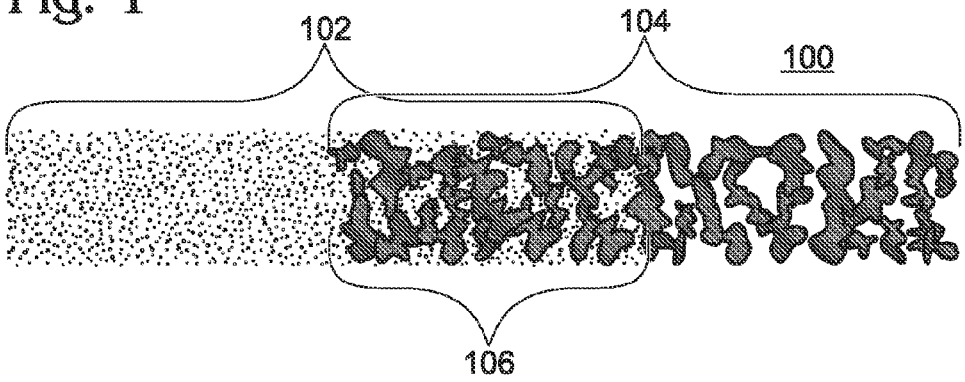
FIG. 1 depicts an example baseline and an example agglomerated line that converge in the middle of the page, in accordance with an embodiment of the disclosure.

Referring now to FIG. 1, a driving surface 100 includes a baseline 102 and an agglomerated line 104. The two lines intersect in the middle to form a dual-swath driving surface marking 106, which may alternatively be referred to as a "modified agglomerate." Markings such as baseline 102, agglomerated line 104 and/or dual-swath driving surface marking 106, as well as any combination thereof, may be applied to any number of driving surfaces. In various embodiments, one or more such markings may be applied to one or more sides and/or a middle of a roadway. In various embodiments, one or more such markings may be applied to other driving or non-driving surfaces, such as parking lots, airplane runways, pedestrian walkways, walking/running tracks, and so forth.

Figure 2:
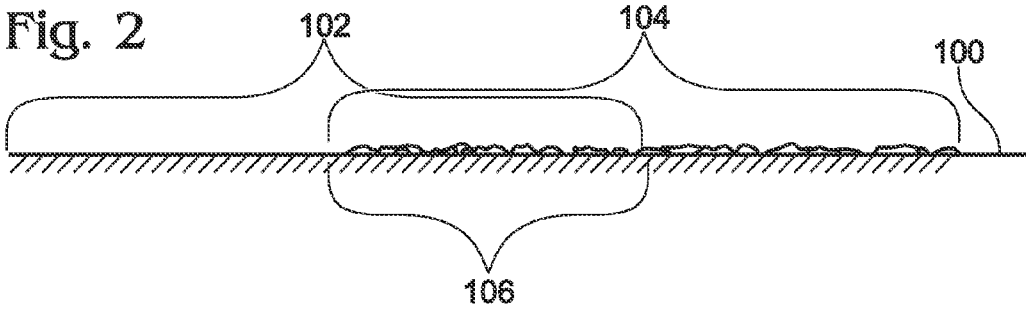
FIG. 2 is a side view depicting the profiles of the baseline and agglomerated line of FIG. 1, in accordance with various embodiments.

Baseline 102 may have a relatively uniform appearance. For example, there may be few, if any, gaps or holes through which surface 100 may be visible. In various embodiments, when viewed from the side and as shown in FIG. 2, baseline 102 may have a substantially uniform profile with little thickness (e.g., such that it is not visible in FIG. 2). For example, baseline 102 may have a profile that does not vary substantially from one point to the next in its thickness on top of surface 100.

Agglomerated line 104 (which may also be referred to as a "splattered line") may have a less uniform appearance than baseline 102. For example, surface 100 may be visible through various gaps and holes in agglomerated line 104. Additionally, when viewed from the side (as shown in FIG. 2), agglomerated line 104 may have a relatively non-uniform and/or varied profile, especially relative to baseline 102. Having a varied profile may make agglomerated line 104 more easily visible to passing motorists, particularly at night. For instance, surfaces of agglomerated line 104 that are not parallel to surface 100 may be more likely to be visible in view of oncoming headlights, particularly where reflective components (not shown in FIG. 1) such as glass beads or reflective elements are embedded within agglomerated line 104.

Combining these two markings may yield dual-swath driving surface marking 106, which may exhibit benefits of both baseline 102 and agglomerated line 104. In various embodiments, baseline 102 may "fill in" gaps or holes in agglomerated line 104, to give dual-swath driving surface marking 106 a uniform appearance when viewed from above. Moreover, when reflective elements are embedded after application of both baseline 102 and agglomerated line 104, the reflective elements may be embedded in portions of baseline 102 that fill in the holes and/or gaps in agglomerated line, further increasing nighttime reflectivity. And reflective elements embedded in baseline 102 may be somewhat protected by agglomerated line 104.

Figure 3:
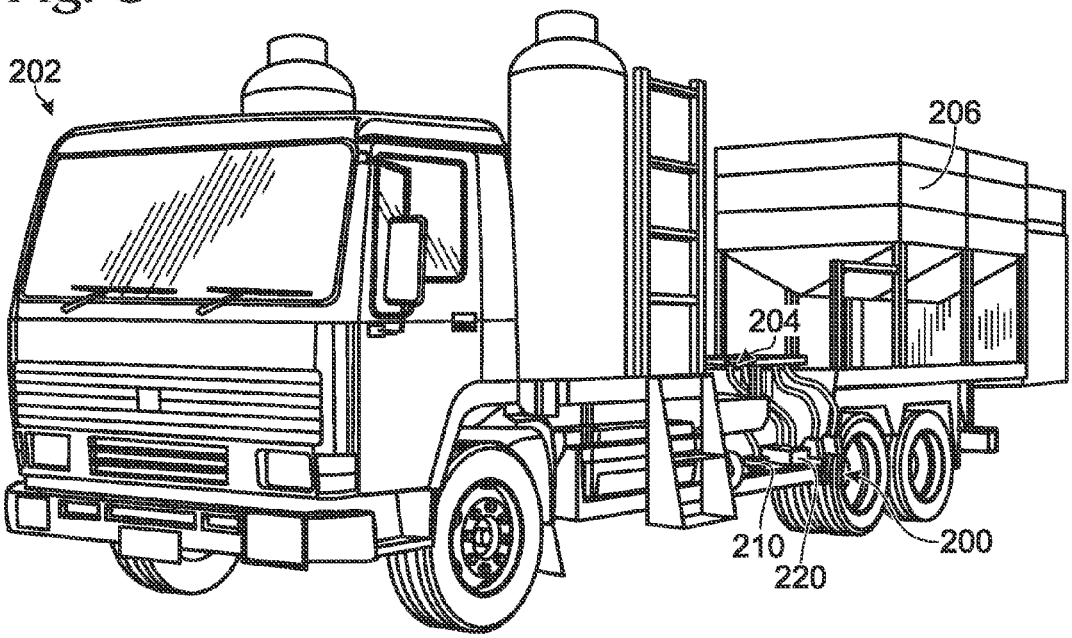
FIG. 3 depicts an example multi-application apparatus mounted on a vehicle, in accordance with various embodiments.
Figure 4:
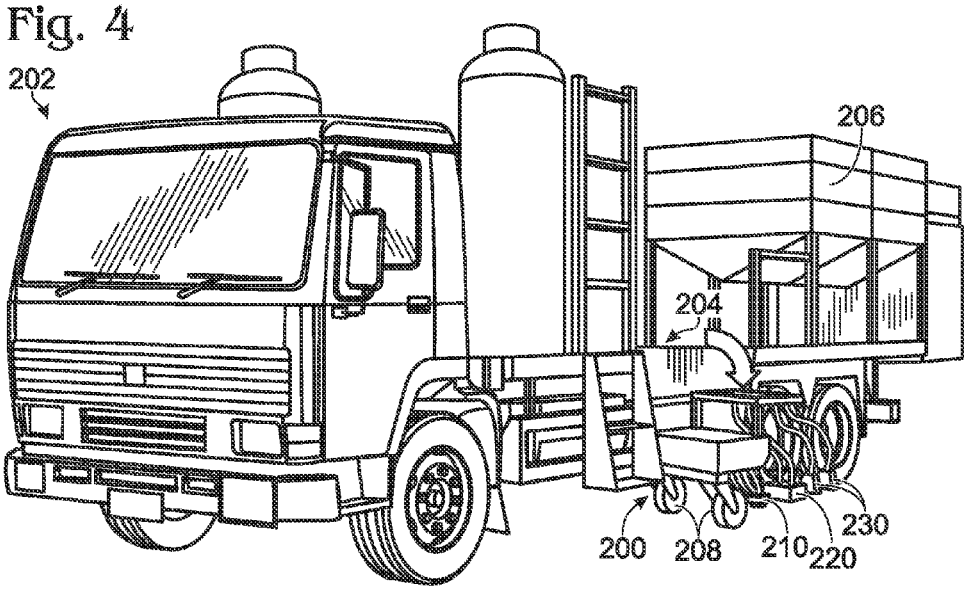
FIG. 4 depicts the example multi-application apparatus of FIG. 3, extended from the vehicle in an operational mode, in accordance with various embodiments.

An example multi-application apparatus 200 for applying multiple swaths of material to a driving surface in a single pass, an example result of which is seen in FIG. 1, is depicted mounted on a vehicle 202 in FIGS. 3 and 4. In FIG. 3, multi-application apparatus 200 is retracted into a holding area 204 of vehicle 202, e.g., in an inactive mode. In FIG. 4, multi-application apparatus 200 is extended out from holding area 204 of vehicle 202, in an operational mode. In various embodiments, multi-application apparatus 200 may be mounted to vehicle 202 so that as vehicle 202 travels, multi-application apparatus 200 may be operated to apply markings to a driving surface, e.g., parallel to a trajectory of vehicle 202.

In various embodiments, vehicle 202 may include one or more reservoirs 206 to hold one or more components that form the material that is applied to a driving surface. In various embodiments, reservoir 206 may include one or more sub-reservoirs (not shown) for binder and one or more sub-reservoirs (not shown) for a catalyst.

Pressure pumps that may be used with reservoirs on buggies may be limited in size, thereby limiting a size of pressure tanks. Accordingly, in various embodiments, reservoir 206 may be a large tank equipped with one or more diaphragm pumps (see FIG. 6). In various embodiments, such a configuration may enable reservoir 206 to have a capacity on the order of 1,000 gallons.

In various embodiments, multi-application apparatus 200 may include a wheel 208 or other supporting structure that may guide and/or support multi-application apparatus 200 along a driving surface. In other embodiments, multi-application apparatus 200 may not include a wheel, and may be supported over a driving surface in part or in whole by structure of vehicle 202.

Figure 5:
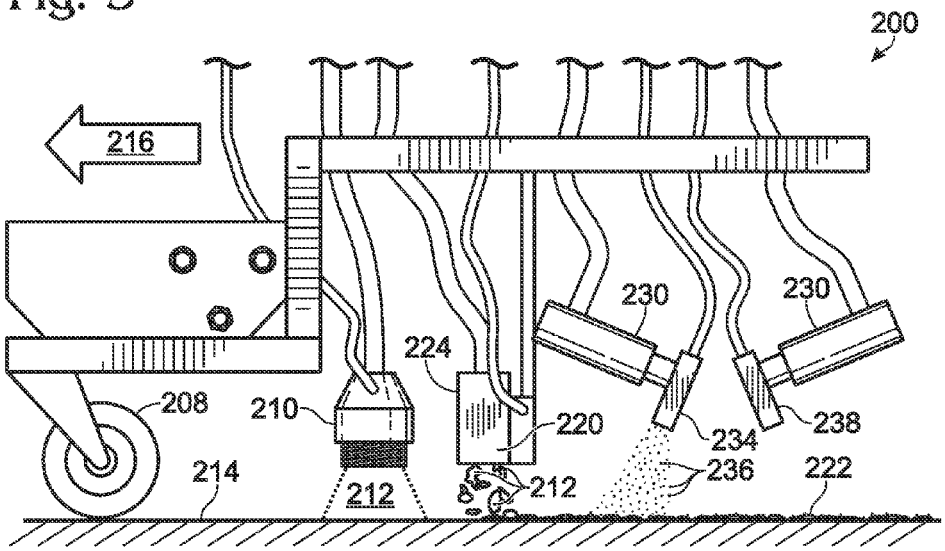
FIG. 5 is a close-up view of the example multi-application apparatus of FIGS. 3-4, in accordance with various embodiments.

Referring now to FIG. 5, in various embodiments, multi-application apparatus 200 may include a baseline applicator 210. In various embodiments, baseline applicator 210 may be used to apply material to a driving surface 214 so that the resulting marking is relatively gap-free and/or has a relatively uniform profile (when viewed from the side). For instance, a baseline applicator 210 may be used to apply a baseline such as baseline 102 in FIG. 1. In various embodiments, baseline applicator 210 may be a sprayer configured to spray material 212, including profileable material, onto a driving surface 214. In various embodiments, baseline applicator 210 may be operated using pressurized air.

In various embodiments, a number of parameters associated with baseline applicator 210 may be independently controlled to affect various aspects of a marking applied to a driving surface, including but not limited to the marking's width, thickness, uniformity, and so forth. In various embodiments, the pressure at which air is used by baseline sprayer 210 may be controlled independently of other parameters associated with operation of multi-application apparatus 200, such as ground speed 216 of vehicle 202. In various embodiments, a material application rate of baseline applicator 210 may be controlled independently of other parameters of multi-application apparatus 200, such as material air pressure and/or ground speed. In various embodiments, a material application volume (e.g., how much material is applied per periodic marking) of baseline applicator 210 may be controlled independently of other parameters of multi-application apparatus 200, such as material application rate, air pressure and/or ground speed.

Spraying a profileable material through some sprayers may cause damage to various components, such as a spray head. This may cause a baseline (e.g., 102 in FIG. 1) on a driving surface to have uneven or rough edges. However, if multiple markings are applied, on top of one another, to a driving surface, it may not be critical that baseline applicator 210 apply clean markings.

For example, multi-application apparatus 200 may include an agglomerated marking applicator 220 configured to apply profileable material 212 in a manner that creates splattered or agglomerated markings 222, such as agglomerated line 104 in FIG. 1. Even if a baseline marking (e.g., 102) has rough or uneven edges, an agglomerated marking (e.g., 104) applied on top of the baseline marking may conceal the uneven edges. Accordingly, it may not be necessary to replace sprayer heads once damaged, thus making it practical to spray profileable material through baseline applicator 210. Additionally, because the same profileable material 212 may be used to apply both a baseline and an agglomerated marking (e.g., 222), both baseline applicator 210 and agglomerating marking applicator 220 may draw profileable material 212 from a single source, such as reservoir 206.

As was the case with baseline applicator 210, various parameters of agglomerated marking applicator 220 may be controlled independently of other parameters associated with apparatus 200. In various embodiments, an air pressure used to operate agglomerated marking applicator 220 may be controlled independently of other parameters of multi-application apparatus 200, such as air pressure used to operate baseline applicator 210 and/or ground speed 216 of vehicle 202. In various embodiments, material application rate and/or material application volume associated with agglomerated marking applicator 220 may also be controlled independently from each another and from other parameters such as air pressure and/or ground speed 216 of vehicle 202.

An agglomerated marking may be applied to driving surface 214 in various ways. In some embodiments, such as the one shown in FIGS. 3-5, agglomerated marking applicator 220 may include a distributor box 224. In other embodiments that are not shown, agglomerated marking applicator 220 may be a shoe or other similar component configured to collect a predetermined amount of material and to drop it on a driving surface at various intervals. In some embodiments, a shoe may drop material on top of a splatter bar or other similar component configured to splatter or otherwise spread the material out over a predetermined distance. In some embodiments, a shoe (not shown) or other similar device may be used without a splatter bar at timed intervals, e.g., to create "audible bumps" in a driving surface marking.

In various embodiments, the same profileable material 212 may be used by both baseline applicator 210 and agglomerated marking applicator 220. In various embodiments, these components may be configured and/or positioned on vehicle 202 so that material applied by one component is not yet dry when the other component applies material. In this manner, an agglomerated line (e.g., 104 in FIG. 1) is not just applied on top of a baseline (e.g., 102 in FIG. 1). Rather, an agglomerated line may be applied so that it is at least partially intermixed, or fused, with the underlying baseline material. Similarly, if the agglomerated marking is applied first, the baseline material may be applied soon enough after (e.g., as part of a single pass of vehicle 202 by an area of a driving surface) that it at least partially fuses with, rather than simply sits on top of, the agglomerated marking.

For example, a resulting marking on a roadway may include a first swath of a profileable material applied to the driving surface with a substantially uniform profile, and a second swath of the profileable material applied to the driving surface at least in part on top of the first swath. In various embodiments, the second swath may have a profile that is more varied than the profile of the first swath. In various embodiments, the profileable material forming the second swath may be at least partially fused with the profileable material forming the second swath. Ensuring that the profileable material used for both markings is at least partially fused may result in a stronger, more durable and/or longer-lasting surface marking.

Multi-application apparatus 200 may also include, in various embodiments, one or more reflective element applicators 230 to apply reflective elements into markings For example, in FIG. 5, a first reflective element applicator 234 may be configured to drop or otherwise apply glass beads 236. A second reflective element applicator 238 may be configured to drop other reflective elements. Because reflective element applicators 230 are part of the same multi-application apparatus 200 as baseline applicator 210 and agglomerated marking applicator 220, reflective elements such as glass beads 236 may be placed into (e.g., embedded in) profileable material immediately after it is applied to a driving surface. This may enable the reflective elements to sink into the profileable material, rather than sitting on top of it. This may also enable the reflective elements to be embedded in the baseline, not just the agglomerated line.

As noted above, embedding reflective components into a viscous material may be difficult. Thus, reflective element applicators 230 may be controllable to embed reflective elements to a level within the profileable material at which the reflective elements are visible to motorists, and yet where the elements will be retained within the profileable material. For example, one or more reflective element applicators 230 may be configured to propel reflective elements into an agglomerated or splattered MMA marking at a particular pressure, to cause the reflective elements to embed at a suitable level within the MMA. In various embodiments, the pressure used to propel the reflective elements may be controllable independently of other parameters (e.g., profileable material application rate, vehicle ground speed, etc.) described herein.

Applying two or more markings to a driving surface in a single pass may have a number of benefits other than those described above. For example, it may avoid the difficulty of applying material to the same line in two separate passes. Additionally, a single pass may reduce traffic disruption, as many surface marking vehicles tend to move slowly and may limit how much other vehicles may pass.

In various embodiments, baseline applicator 210 and/or agglomerated marking applicator 220 may be fed profileable material using various configurations of one or more pumps. As noted above, these pumps and various associated parameters may be controlled independently to allow adjustment of the parameters described above, e.g., material application rate, application volume, and so forth.

Figure 6:
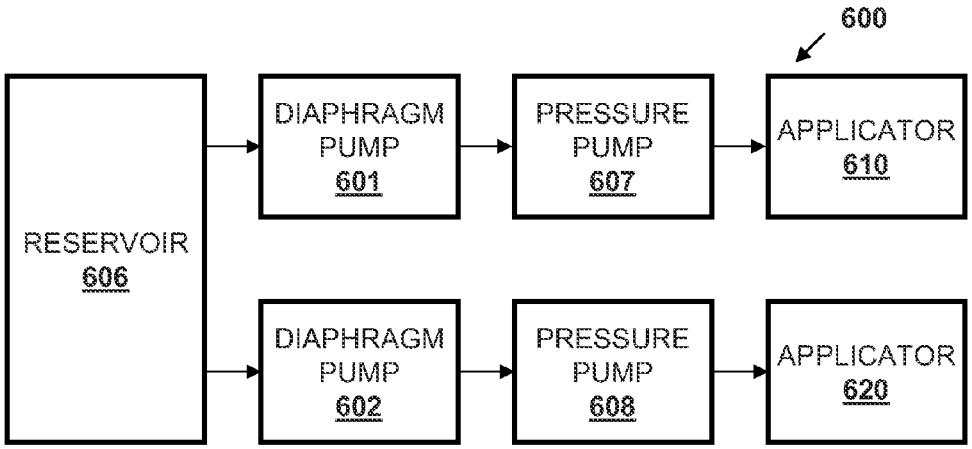
FIG. 6 schematically depicts an example configuration of pumps and other components of an example multi-application apparatus, in accordance with various embodiments.

FIG. 6 schematically depicts one example configuration 600 of pumps and other components that may be implemented in a multi-application apparatus such as multi-application apparatus 200 of FIGS. 3-5, in accordance with various embodiments. Two (or more) diaphragm pumps, 601 and 602, may transfer profileable material from a reservoir 606 (e.g., 206 in FIG. 2) to first and second pressure pumps, 607 and 608, respectively. After the profileable material has been transferred to the pressure pumps 607 and 608, then each pressure pump may be configured to transfer profileable material to an appropriate applicator, such as applicators 610 and 620. In various embodiments, applicators 610 and 620 may be any type of device configured to apply material (e.g., 212 in FIG. 2) to a surface, including but not limited to a baseline applicator (e.g., 210), an agglomerated marking applicator (e.g., 220), a splatter bar/shoe combination, or any combination thereof.

In various embodiments, a skip timer (not shown) may be employed to control timed application of profileable material between two or more applicators, e.g., baseline applicator 210 and agglomerated marking applicator 220, so that the multiple applicators apply profileable material to substantially the same portions of a driving surface. For example, where dashed lines are desired, the skip timer may be used, in some cases in conjunction with adjustment of ground speed of a vehicle on which a multi-application apparatus is mounted, to coordinate a leading edge of an agglomerated/splattered line (e.g., 104 in FIG. 1) with a leading edge of a baseline (e.g., 102 in FIG. 1). The same skip timer or a different skip timer may be utilized to coordinate an end of an agglomerated/splatter line with the end of a baseline.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

What is claimed is:

1. A multi-application apparatus configured to be mounted on a vehicle and comprising:

a sprayer to spray, at a first pressure, a profileable material onto an area of a driving surface during a pass of the vehicle by the area to create a baseline;

an applicator to apply, at a second pressure that is less than the first pressure, the profileable material directly to at least a portion of the baseline during the same pass of the vehicle by the area to create an agglomerated marking, wherein the applicator is configured to apply the profileable material in a manner such that the resulting agglomerated marking has a more varied profile than the baseline; and controls to facilitate, during operation of the multi-application apparatus, independent control of two or more of an application rate of the sprayer, an application rate of the applicator, and an air pressure associated with the sprayer.

2. The multi-application apparatus of claim 1, wherein the applicator comprises a splatterbar.

3. The multi-application apparatus of claim 1, further comprising a reflective element applicator configured to apply reflective elements to the profileable material forming the baseline and agglomerated marking.

4. The multi-application apparatus of claim 3, wherein the reflective element applicator is configured to embed the reflective elements in the profileable material forming both the baseline and agglomerated marking.

5. The multi-application apparatus of claim 1, wherein the controls are further configured to facilitate, during operation of the application apparatus, independent control of an application volume by the sprayer or applicator.

6. The multi-application apparatus of claim 1, wherein the controls are further configured to facilitate, during operation of the application apparatus, independent control of an air pressure associated with the applicator.

7. The multi-application apparatus of claim 1, wherein the sprayer is configured to spray, and the applicator is configured to apply, methyl methacrylate.

8. The multi-application apparatus of claim 1, wherein the sprayer is configured to spray, and the applicator is configured to apply, thermoplastic.

9. The multi-application apparatus of claim 1, further comprising a single reservoir operably coupled with the sprayer and applicator, to contain the profileable material for provision to the sprayer and the applicator.

10. The multi-application apparatus of claim 9, wherein the reservoir is operably coupled with the sprayer with a diaphragm pump and a pressure pump.

11. The multi-application apparatus of claim 2, wherein the applicator further comprises a shoe to feed the splatterbar.

* * * * *